US005167878A

United States Patent [19]

Arbisi et al.

[11] Patent Number: 5,167,878

[45] Date of Patent: Dec. 1, 1992

[54] SUBMERSIBLE AERATION DEVICE

[75] Inventors: Dominic S. Arbisi, Minnetonka; Charles C. S. Song, Excelsior, both of Minn.

[73] Assignee: Aeras Water Systems, Inc., Minnetonka, Minn.

[21] Appl. No.: 747,748

[22] Filed: Aug. 20, 1991

[51] Int. Cl.[5] ..... B01F 3/04; B01F 5/02

[52] U.S. Cl. ..... 261/30; 261/37; 261/77; 261/DIG. 75

[58] Field of Search ..... 261/37, DIG. 75, 30, 261/77

[56] References Cited

U.S. PATENT DOCUMENTS

| | | | |
|---|---|---|---|
| 950,999 | 3/1910 | Erlwein et al. . | |
| 1,526,179 | 2/1925 | Parr et al. . | |
| 1,747,687 | 2/1930 | Wheeler . | |
| 3,320,928 | 5/1967 | Smith | 119/3 |
| 3,589,997 | 6/1971 | Grutsch et al. | 210/13 |
| 3,756,578 | 9/1973 | McGurk | 261/91 |
| 3,984,323 | 10/1976 | Evens | 261/DIG. 75 |
| 4,132,838 | 1/1979 | Krener et al. | 261/DIG. 75 |
| 4,152,259 | 5/1979 | Molvar | 261/DIG. 75 |
| 4,162,970 | 7/1979 | Zlokarnik | 210/15 |
| 4,168,705 | 9/1979 | Raab | 261/DIG. 75 |
| 4,186,772 | 2/1980 | Handleman | 137/604 |
| 4,215,082 | 7/1980 | Danel | 261/124 |
| 4,226,719 | 10/1980 | Woltman | 261/DIG. 75 |
| 4,229,302 | 10/1980 | Molvar | 210/220 |
| 4,261,347 | 4/1981 | Spencer, III et al. | 261/DIG. 75 |
| 4,268,398 | 5/1981 | Shuck et al. | 210/758 |
| 4,271,099 | 6/1981 | Kukla | 261/76 |
| 4,308,138 | 12/1981 | Woltman | 210/220 |
| 4,389,312 | 6/1983 | Beard | 210/198.1 |
| 4,411,780 | 10/1983 | Suzuki et al. | 261/DIG. 75 |
| 4,514,343 | 4/1985 | Cramer et al. | 261/DIG. 75 |
| 4,522,151 | 6/1985 | Arbisi et al. | 119/3 |
| 4,707,308 | 11/1987 | Ryall | 261/77 |
| 4,710,325 | 12/1987 | Cramer et al. | 261/24 |
| 4,911,836 | 3/1990 | Haggerty | 210/170 |
| 5,023,021 | 6/1991 | Conrad | 261/DIG. 75 |

FOREIGN PATENT DOCUMENTS

| | | | |
|---|---|---|---|
| 893014274 | 2/1989 | European Pat. Off. . | |
| 1345673 | 11/1963 | France | 261/DIG. 75 |
| 1377571 | 9/1964 | France | 261/DIG. 75 |
| 258216 | 3/1987 | German Democratic Rep. . | |
| 1421715 | 11/1986 | U.S.S.R. . | |
| 14473 | of 1912 | United Kingdom | 261/77 |
| 942754 | 11/1963 | United Kingdom | 261/DIG. 75 |
| 2072027 | 1/1981 | United Kingdom . | |

*Primary Examiner*—Tim Miles

*Attorney, Agent, or Firm*—Merchant, Gould, Smith, Edell, Welter & Schmidt

[57] ABSTRACT

The present invention provides a device designed to more efficiently aerate a body of liquid. The aeration device generally includes a nozzle, a liquid delivery means, and an air delivery means. The nozzle is submersed within the body of liquid and directed substantially laterally relative to the surface of the body of liquid. The nozzle includes a liquid delivery tube, which defines an upstream end of the nozzle, a coaxially aligned contraction member having a converging profile, a coaxially aligned throat member having a uniform diameter, and a coaxially aligned diffuser member having a diverging profile and an exit facing downstream, and a coaxially aligned focus member having a uniform diameter all of which are in fluid communication in series relative to one another. The liquid delivery tube is in fluid communication with the liquid delivery means, which draws liquid from the body of liquid and delivers it under pressure to the liquid delivery tube. An air delivery tube, extending concentrically within the liquid delivery tube and the contraction member, also has an exit that faces downstream. The air delivery tube is in fluid communication with the air deilvery means, which delivers air from the atmosphere to the air delivery tube.

24 Claims, 4 Drawing Sheets

SUBMERSIBLE AERATION DEVICE

FIELD OF THE INVENTION

The present invention relates generally to means for aerating a body of liquid, and more particularly, to a submersible aeration device with a laterally extending nozzle.

BACKGROUND OF THE INVENTION

The concept of introducing air into a receiving body of liquid may be referred to generally as "aeration." In one respect, aeration is a proven and widely used technology in connection with waste treatment and lake water quality improvements, where the benefits of aeration are recognized by those skilled in the art. Among other things, it is often desirable to aerate a pond in order to minimize algae growth and avoid any potential accumulation of noxious gases, which also inherently benefits aquatic life. Ultimately, the introduction of oxygen and current to a body of water prevents the water from becoming anaerobic. Relative to currently known and/or available aeration devices, the present invention provides an aeration device that operates more efficiently over a wider range of applications.

SUMMARY OF THE INVENTION

The present invention provides a device designed to more efficiently aerate a body of liquid. The aeration device generally includes a nozzle, a liquid delivery means, and an air delivery means. The nozzle is submersed within the body of liquid and directed substantially laterally relative to the surface of the body of liquid. The nozzle includes a liquid delivery tube, which defines an upstream end of the nozzle, a coaxially aligned contraction member having a converging profile, a coaxially aligned throat member having a uniform diameter, and a coaxially aligned diffuser member having a diverging profile and an exit facing downstream, all of which are in fluid communication in series relative to one another. The liquid delivery tube is in fluid communication with the liquid delivery means, which draws liquid from the body of liquid and delivers it under pressure to the liquid delivery tube. An air delivery tube, extending concentrically within the liquid delivery tube and the contraction member, also has an exit that faces downstream. The air delivery tube is in fluid communication with the air delivery means, which delivers air from the atmosphere to the air delivery tube.

The two-phase flow of water and air that is achieved with the present invention requires less pressure to fracture the incoming air and produces tiny air bubbles that tend to remain submersed in the water longer than larger air bubbles produced by other devices. Not only is the present invention more efficient than other known devices, but it also is capable of functioning without modification in water as shallow as 1 foot and as deep as 10 feet. Moreover, the addition of a blower enables the present invention to function at considerably deeper levels of submergence. In addition to introducing a large volume of air into the water in very small individual quantities, the present invention also provides a great deal of horizontal circulation, which enhances distribution of air throughout the body of water.

Those skilled in the art will recognize that the present invention provides several additional advantages. For example, except for the power supply and the exposed part of the air delivery means, the aerator is entirely submersible, allowing it to rest on the bottom of a body of water and provide more thorough circulation. Additionally, the submersible feature minimizes the aesthetic impact of the aerator on its operating environment, as well as its vulnerability to potential vandals or thieves. A related feature is the relative compactness and portability of the aerator, which facilitates quick and easy installation and removal. These and other advantages will become apparent upon a more detailed description of a preferred embodiment.

BRIEF DESCRIPTION OF THE DRAWING

Referring to the FIGS., wherein like numerals represent like parts throughout the several views.

DETAILED DESCRIPTION OF A PREFERRED EMBODIMENT

Figures 1, 3, 4:
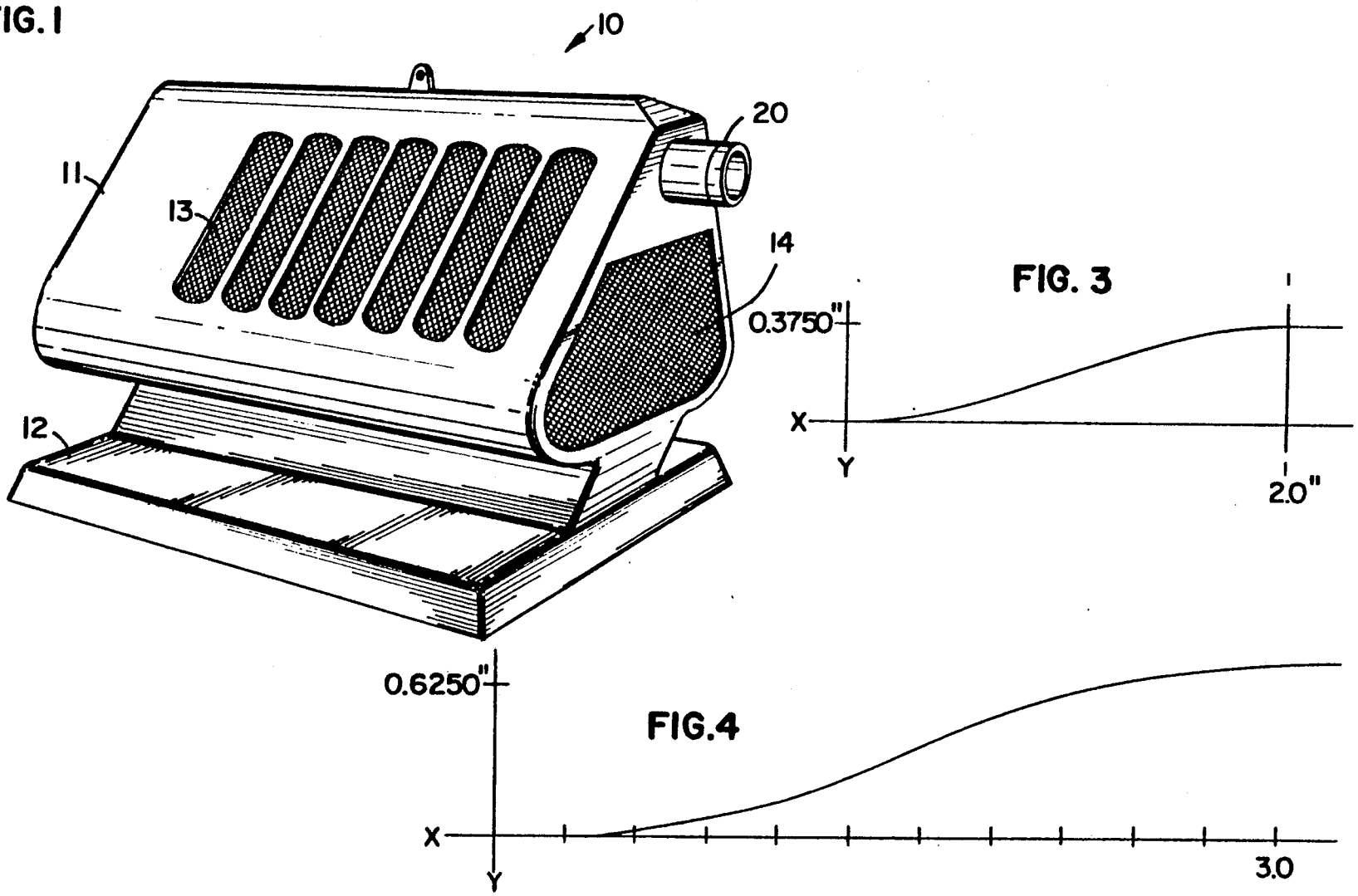
FIG. 1 is a perspective view of a submersible aerator constructed according to the principles of the present invention.
FIG. 3 is a graphical depiction of the curvature of the contraction member of a nozzle for a submersible aerator of the type shown in FIG. 1 and having a 1/2 horse power motor.
FIG. 4 is a graphical depiction of the curvature of the contraction member of a nozzle for a submersible aerator of the type shown in FIG. 1 and having a 1 horsepower motor.
Figure 2:
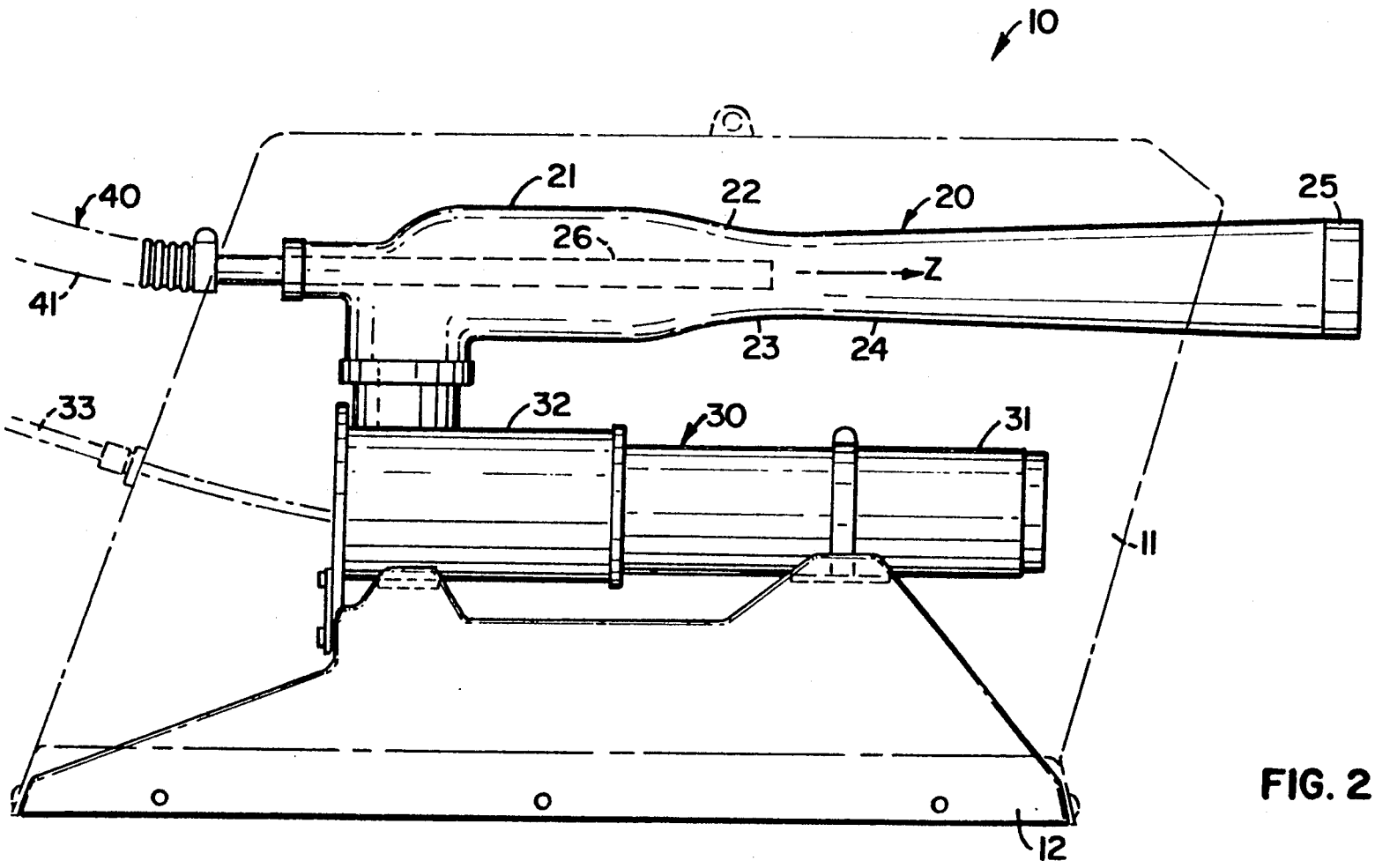
FIG. 2 is a side view of the submersible aerator shown in FIG. 1, with the upper portion of the housing removed.

Referring to FIGS. 1 and 2, an aeration device constructed according to the principles of the present invention is designated generally at 10. While those skilled in the art will recognize that the present invention may be used in connection with a variety of liquids, a preferred embodiment will be discussed with reference to operation in a body of water, such as a pond.

Figure 5:
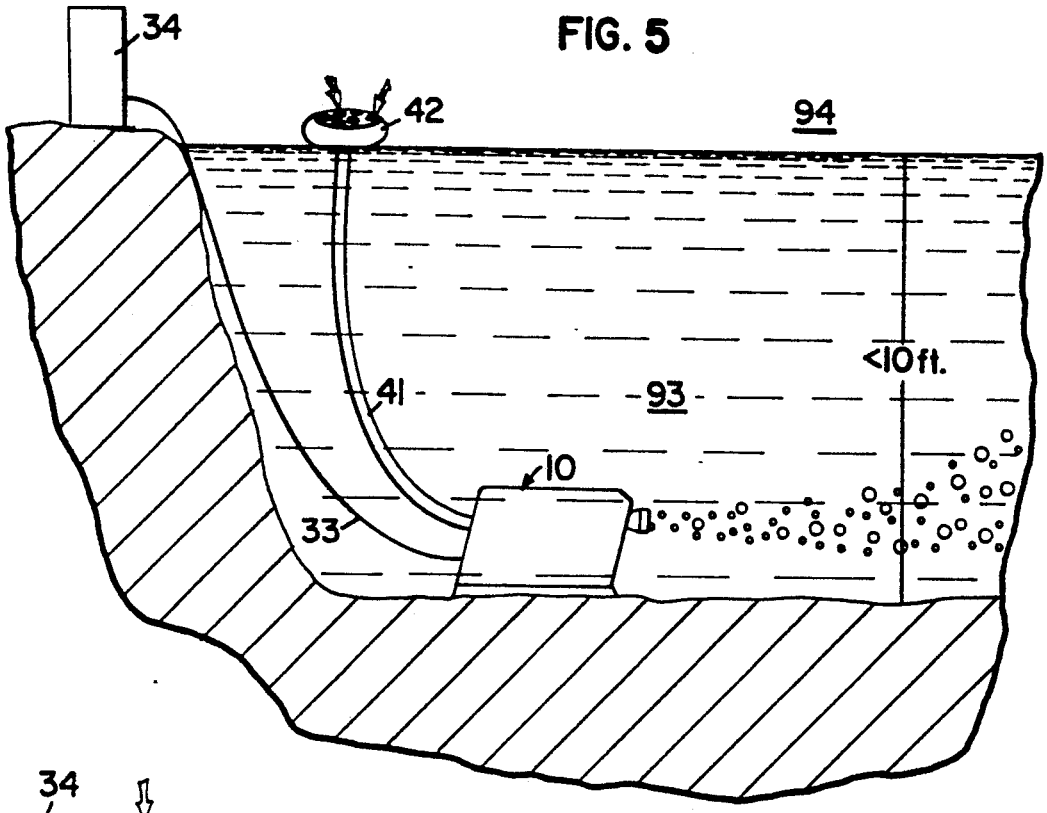
FIG. 5 is a diagrammatic side view of the submersible aerator shown in FIG. 1, positioned in a body of water less than ten feet deep and connected to a floating air intake and a land-based power supply.
Figure 6:
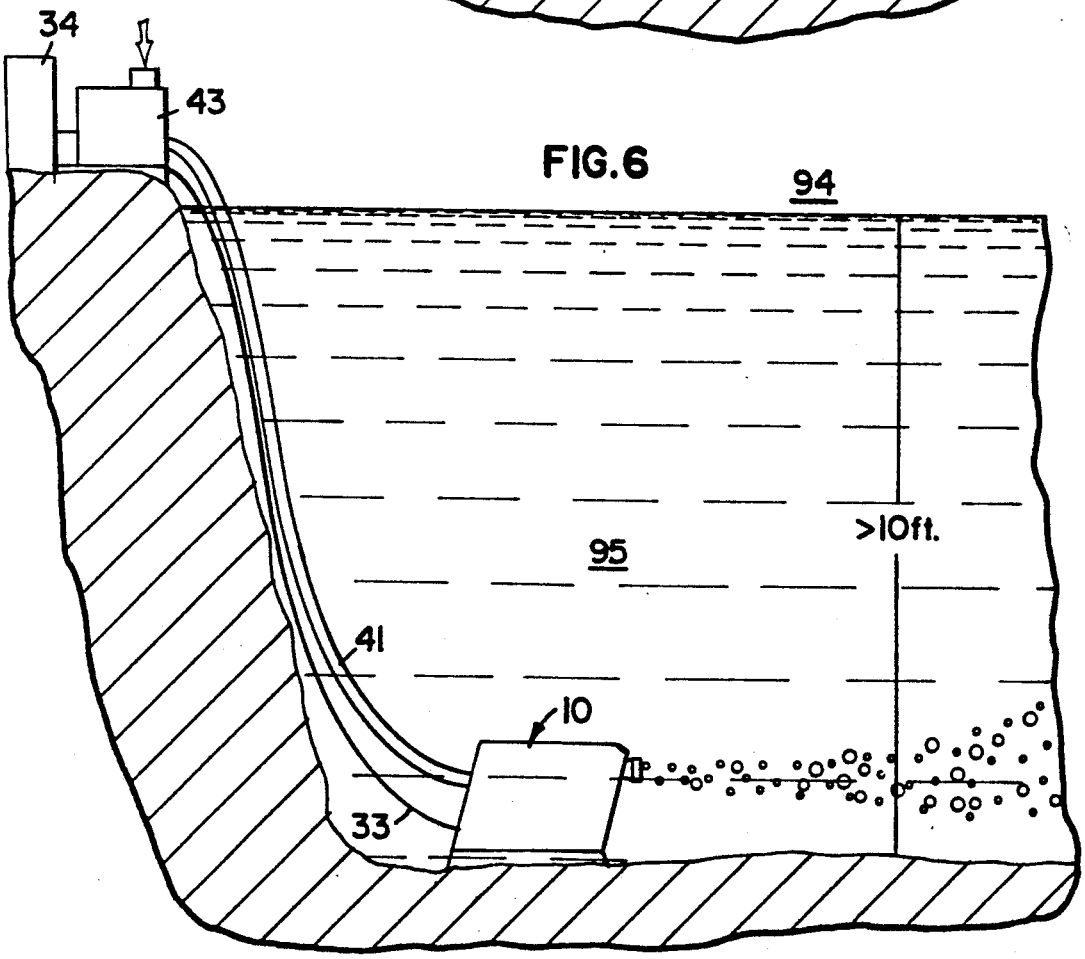
FIG. 6 is a diagrammatic side view of the submersible aerator shown in FIG. 1, positioned in a body of water greater than ten feet deep and connected to a land-based air compressor and a land-based power supply.

The aeration device 10 generally includes a nozzle 20, a liquid delivery means (or water delivery means) 30, and an air delivery means 40. The nozzle 20 and the water delivery means 30, as well as a portion of the air delivery means 40, are positioned within housing 11, which functions as a submersible unit, as shown in FIGS. 5 and 6. The housing 11 includes a base portion 12 that is designed to maintain the aeration device 10 in an operating orientation, with the nozzle 20 extending in a substantially lateral direction relative to the surface of the body of water 93. The housing 11 also includes screened openings 13 and 14 on the sides and front of the housing 11, respectively. The screened openings 13 and 14 place the water delivery means 30 in fluid communication with the body of water 93, while preventing debris from entering the housing 11.

Referring to FIG. 2, the nozzle 20 includes a liquid delivery tube (or water delivery tube) 21 having a central longitudinal axis and defining a flow direction Z along the central axis. The water delivery tube 21 is in fluid communication with a coaxially aligned contraction member 22, which is located downstream along the flow direction Z relative to the water delivery tube 21. At the point of connection between the water delivery tube 21 and the contraction member 22, the orifices defined by the water delivery tube 21 and the contraction member 22 are substantially equal. In a first preferred embodiment, having a ½ horsepower motor, the orifices are 2 inches in diameter, and in a second preferred embodiment, having a 1 horsepower motor, the orifices are 3 inches in diameter. The orifice defined by the contraction member 22 narrows along the length of the contraction member 22 in the direction of the flow Z, such that the egress diameter of the contraction member 22 is less than the ingress diameter of the contraction member 22. In the first preferred embodiment, the converging profile of the contraction member 22 is defined by the equation $y=(3/32)x^2(3-x)$, which is graphically depicted in FIG. 3, where x is a measure of the distance along the length of the contraction member 22, beginning from its point of connection with the water delivery tube 21, and y is a measure of the decrease in radius of the contraction member 22 along the same length of the contraction member 22. In the second preferred embodiment, the converging profile of the contraction member is defined by the equation $y=x^3(0.23148-0.11574x+0.015432x^2)$, which is graphically depicted in FIG. 4, where x and y are similarly defined.

The contraction member 22 is in fluid communication with a coaxially aligned throat member 23, which is located downstream along the flow direction Z relative to the contraction member 22. At the point of connection between the contraction member 22 and the throat member 23, the orifices defined by the contraction member 22 and the throat member 23 are substantially equal. In the first preferred embodiment, the orifices are 1¼ inches in diameter, and in the second preferred embodiment, the orifices are 1¾ inches in diameter. The throat member 23 is of uniform diameter along its length. The throat member 23 is in fluid communication with a coaxially aligned diffuser member 24, which is located downstream along the flow direction Z relative to the throat member 23. At the point of connection between the throat member 23 and the diffuser member 24, the orifices defined by the throat member 23 and the diffuser member 24 are also substantially equal. In the first preferred embodiment, the orifices are 1¼ inches in diameter, and in the second preferred embodiment, the orifices are 1-3/4 inches in diameter. The orifice defined by the diffuser member 24 widens along the length of the diffuser member 24 in the direction of flow Z, such that the egress diameter of the diffuser member 24 is greater than the ingress diameter of the diffuser member 24. In the first preferred embodiment, the egress diameter is 2 inches, and in the second preferred embodiment, the egress diameter is 3 inches. In each embodiment, the wall of the diffuser member 24 deviates from the central axis, thereby defining a diverging profile. The diffuser member 24 is in fluid communication with a coaxially aligned focus member 25, which is located downstream along the flow direction Z relative to the diffuser member 24. In each embodiment, the focus member 25 is of uniform diameter along its length, equal to the corresponding egress diameter of the diffuser member 24. The focus member 25 exits downstream into the body of water 93.

As shown in FIG. 2, water is pumped from the body of water 93 under pressure to the water delivery tube 21 by a water delivery means 30, which includes a motor means 31 and a pump means 32 connected to a land-based power supply means 34 (shown in FIGS. 5 and 6) by way of a cable 33. In a preferred embodiment, the motor 31 and the pump 32 are mounted to the base portion 12 of the housing 11, below the nozzle 20 when the aerator 10 is in an upright, operable orientation. The pump 32 is in fluid communication with the water delivery tube 21, and water is delivered to the nozzle 20 in a direction substantially perpendicular to the central longitudinal axis of the nozzle 20. As defined above, the water delivery means 30 is driven by a ½ horsepower motor in the first preferred embodiment, and by a 1 horsepower motor in the second preferred embodiment.

Water is pumped from the body of water 93 into the water delivery tube 21, which defines an upstream end of the nozzle 20. The water flows through the water delivery tube 21, and into and through the contraction member 22, and into and through the throat member 23, and into and through the diffuser member 24, and into and through the focus member 25, which defines a downstream end of the nozzle 20. The water exits the focus member 25 back into the body of water 93. In a preferred embodiment, the water delivery tube 21, the contraction member 22, the throat member 23, the diffuser member 24, and the focus member 25 are all integral portions of a single piece nozzle 20, and the transitions between the various portions are uninterrupted. In the first preferred embodiment, the water delivery tube is at least 2 inches long; the contraction member is 2 inches long; the throat member is 2 inches long; the diffuser member is 12 inches long; and the focus member is ½ inch long. In the second preferred embodiment, the water delivery tube is at least 3 inches long; the contraction member is 3 inches long; the throat member is 2 inches long; the diffuser member is 15 inches long; and the focus member is 1 inch long. Those skilled in the art will recognize that the dimensions of the components may be varied, and with varying results.

A coaxially aligned air delivery tube 26 is inserted within the nozzle 20, extending through the water delivery tube 21 and the contraction member 22. In the first preferred embodiment, the air delivery tube 26 is uniform in diameter with a ½ inch inner diameter and a ¾ inch outer diameter. In the second preferred embodiment, the outer diameter of the air delivery tube is ⅞ inch. The air delivery tube 26 extends to the juncture between the contraction member 22 and the throat member 23, though the aerator will remain effective if the air delivery tube 26 is within ½ inch of this juncture. The end of the air delivery tube 26 defines an exit that faces downstream into the throat member 23. An optional screen (not shown) may be placed over the exit of the air delivery tube 26 to fracture air as it enters the flow. The air delivery tube 26 is exposed to the atmosphere by way of the air delivery means 40.

In a preferred embodiment for relatively shallow submersion, shown in FIG. 5, the aerator 10 is intended for use in a body of water 93 no deeper than ten feet, and the air delivery means 40 includes a hose 41 extending between the air delivery tube 26 and a floating air intake 42. Alternatively, the air intake may be based on the shore adjacent the body of water. In a preferred embodiment for relatively deep submersion, shown in FIG. 6, the aerator 10 is intended for use in a body of water 95 deeper than ten feet, and the air delivery means 40 includes a hose 91 extending between the air delivery tube 26 and a land-based air compressor means 43. To compensate for the greater water pressure, the air compressor means 43 delivers air under pressure to the air delivery tube 26.

In operation, as a result of the converging profile of the contraction member 22, the water flowing through the contraction member 22 exits the contraction member 22 at lesser pressure and greater velocity than that at which it enters the contraction member 22. The reduced pressure and increased velocity of the forced flow of water through the contraction member 22 creates a low pressure cavity in the throat member 23 immediately downstream from the exit of the air delivery tube 26, which low pressure cavity is below atmospheric pressure. Accordingly, air from the atmosphere 94 is drawn from the air delivery means 40 and into the flow of water, creating a two-phase (water and air) flow downstream from the air delivery tube 26. The pressurized two-phase flow causes rapid and intense mixing of the air and water, and the diverging profile of the diffuser member 24 allows the mixed flow to recover ambient pressure prior to exiting the nozzle 20. In other words, the two-phase flow through the diffuser member 24 exits the diffuser member 24 at a greater pressure and lesser velocity than that at which it enters the diffuser member 24. The focus member 25 focuses the exiting flow, directing it laterally relatively to the surface of the body of water, thereby increasing horizontal circulation in the body of water.

Experimental Testing

Figure 7:
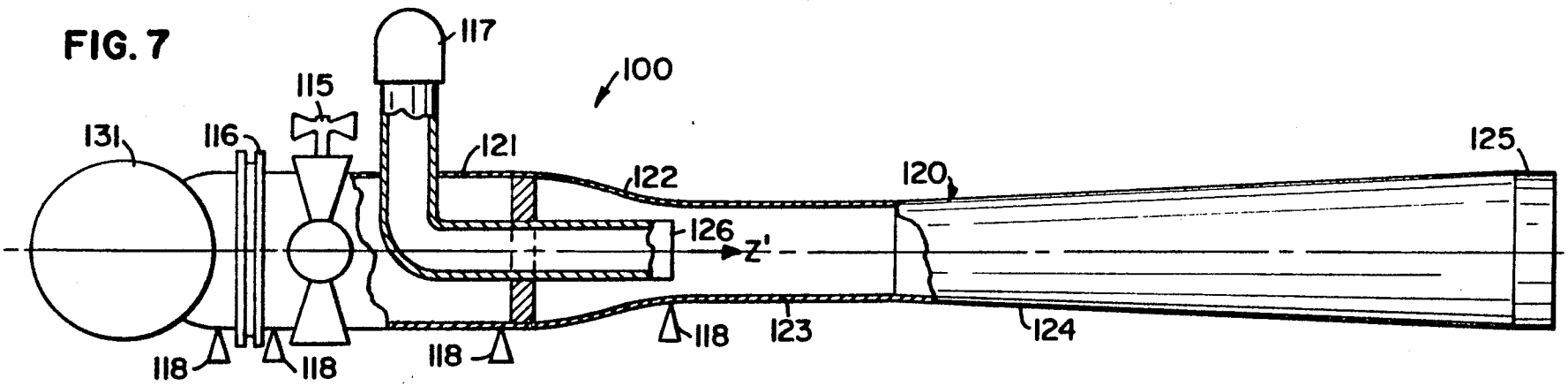
FIG. 7 is a side view of a nozzle constructed according to the principles of the present invention and operatively connected to laboratory equipment for purposes of experimental testing.

Referring to FIG. 7, an experimental embodiment of an aerator constructed according to the principles of the present invention is designated generally at 100. The experimental nozzle 120 was constructed of a transparent material to facilitate observation of the flow and the cloud of air bubbles generated by the flow. The nozzle 120 included a water delivery tube 121, a contraction member 122, a throat member 123, a diffuser member 124, a focus member 125, and an air delivery tube 126, all corresponding in size, shape, and relative orientation to the similarly named parts of the first preferred embodiment nozzle 20.

In a laboratory, a flow control valve 115 and an orifice meter 116 were placed between the nozzle 120 and a pump 131. The orifice meter 116 measured water flow rate; an air flow meter 117 measured air flow rate; and pressure taps 118 located at the contraction entrance and the air exit chamber provided the additional data necessary to evaluate the performance of the nozzle.

The following Bernoulli equation relates the flow between the entrance of the contraction member 122 and the throat member 123, $$\frac{Q_w^2}{2A_c^2} + \frac{P_c}{p} = \frac{Q_w^2}{2A_t^2} + \frac{P_t}{p}$$

where $Q_w$ is the water flow rate, P is pressure, p is the density of water, A is the cross-sectional area, and the subscripts c and t represent the contraction entrance and the throat, respectively.

Similarly, the following Bernoulli equation relates the flow between the throat member 123 and the exit of the diffuser member 124, $$\frac{Q_w^2}{2A_t^2} + \frac{P_t}{p} = \frac{Q_w^2}{2A_d^2} + gh$$

where h is the submergence of the nozzle and the subscript d represents the diffuser exit.

Where the pressure in the throat member ($P_t$) is less than zero, the nozzle functions as an aspirator, and the second Bernoulli Equation dictates the amount of suction that can be generated for given submergence and water flow rate. The first Bernoulli Equation then dictates the head that the pump must generate.

The experimental aerator 100 was place-d at the bottom of a test tank five feet wide, 4 feet high, and 23 feet long, and experiments were conducted at submergence levels of 1 foot, 2 feet, and 3 feet. Prior to testing, any dissolved oxygen in the water was chemically removed. For a given water flow rate and various air flow rates, the subsequent change in dissolved oxygen was measured at various locations within the tank. The resulting data indicated that the distribution of dissolved oxygen was substantially uniform throughout the tank due to the mixing by the jet induced current. The parameters for each of the experimental iterations are provided below in Table 1. Note that air compressor means (a blower) was attached to the air delivery tube 125 for Runs 13 and 14.

TABLE 1

Conditions of DO Recovery Rate Experiments

| Run # (ft) | $Q_w$ (cfs) | $Q_a$ (cfs) | Submergence |
|---|---|---|---|
| 2 | 0.175 | 0.041 | 3.0 |
| 3 | 0.175 | 0.041 | 1.0 |
| 4 | 0.175 | 0.039 | 2.0 |
| 5 | 0.180 | 0.020 | 3.0 |
| 6 | 0.138 | 0.020 | 3.0 |
| 7 | 0.180 | 0.019 | 2.0 |
| 8 | 0.125 | 0.019 | 2.0 |
| 9 | 0.160 | 0.019 | 2.0 |
| 10 | 0.175 | 0.028 | 3.0 |
| 11 | 0.150 | 0.028 | 3.0 |
| 12 | 0.180 | 0.020 | 3.0 |
| 13 | 0.170 | 0.068 | 3.0 |
| 14 | 0.170 | 0.094 | 2.0 |

The maximum air flow rate attainable was substantially linearly proportional to the water flow rate, indicating that the aerator pump should be designed to produce maximum discharge at a head sufficient to overcome the energy loss. Also, for a given water flow rate, there was a maximum air flow rate, beyond which the flow became unstable However, this flow instability was overcome by adding a flower to the system.

While the present invention has been described in terms of a preferred embodiment and specific experimental testing, those skilled in the art will recognize that the present invention extends to a wide range of embodiments and applications. For example, various sizes of motors and pumps are contemplated for various sizes of bodes of water and for bodies of liquid other than water. In such cases the optimum nozzle configuration would vary accordingly, and thus, the scope of the present invention is to be limited only by the appended claims.

What is claimed is:

1. An aeration device of a type that aerates a body of liquid, comprising:

(a) a nozzle, submersed within the body of liquid and directed substantially laterally relative to the surface of the body of liquid, comprising:

(i) a liquid delivery tube, defining an upstream end of said nozzle;

(ii) a contraction member, in fluid communication with and downstream from said liquid delivery tube, wherein said contraction member has a converging profile;

(iii) a throat member, in fluid communication with and downstream from said contraction member, said throat member having a uniform diameter;

(iv) a diffuser member, in fluid communication with and downstream from said throat member, wherein said diffuser member has a diverging profile having an outlet diameter to length ratio of about 1:5 to 1:6, and an exit that faces downstream and into the body of liquid;

(v) an air delivery tube, extending within said liquid delivery tube and said contraction member proximate to said throat member, and having an exit that faces downstream, said air delivery tube being arranged and configured to entrain delivered air into liquid which is present in said contraction member;

(b) liquid delivery means, in fluid communication with said liquid delivery tube, for delivering liquid under pressure to said liquid delivery tube; and (c) air delivery means, exposed to that atmosphere and in fluid communication with said air delivery tube, for delivering air from the atmosphere to said air delivery wherein said diffuser member is arranged and configured of a substantially enough length such that the pressure recovery created by the diverging profile of said diffuser member causes the fluid around the air in said diffuser member to collapse on the air within said diffuser member, whereby the bubble size is minimized and aeration is maximized.

2. The device according to claim 1, wherein the inlet to outlet ratio of aid diffuser member is between 0.55 and 0.65.

3. A device according to claim 1, wherein said nozzle further comprises a focus member, in fluid communication with and downstream from said diffuser member, wherein said focus member has a uniform diameter and an exit that faces downstream and into the body of liquid.

4. A device according to claim 1, wherein said liquid delivery tube, said contraction member, said diffuser member, and said air delivery tube are coaxial.

5. A device according to claim 1, wherein the converging profile of said contraction member is defined by the equation $y=(3/32)*(x)*(x)*(3-x)$, where x represents a measure of distance along the length of said contraction member and y represents a measure of decrease in radius of said contraction member along the length.

6. A device according to claim 1, wherein the converging profile of said contraction member is defined by the equation $y=x^3(0.23148-0.11574x+0.15432x^2)$, where x represents a measure of distance along the length of said contraction member, and y represents a measure of decrease in radius of said contraction member along the length.

7. A device according to claim 1, wherein said delivery air tube extends to within ½ inch of said throat member.

8. A device according to claim 1, wherein said liquid delivery means includes liquid pump means, exposed to the body of liquid and in fluid communication with said liquid delivery tube, for pumping liquid from the body of liquid to said liquid delivery tube; motor means, operatively connected to said pump means, for driving said pump means; and power supply means, operatively connected to said motor means, for powering said motor means.

9. A device according to claim 8, wherein said pump means is designed to operate down to ten feet under a body of water, and said air delivery means includes a floating air intake in fluid communication with said air delivery tube by way of a hose therebetween.

10. A device according to claim 8, wherein said nozzle and said liquid delivery means are contained within a submersible unit.

11. A device according to claim 10, wherein said liquid delivery means is positioned beneath said nozzle when the device is an operative position.

12. A device according to claim 8, further comprising a screened opening between the liquid and said liquid pump means.

13. A device according to claim 8, further comprising air compressor means in fluid communication with said air delivery tube, for delivering air under pressure to said air delivery tube.

14. A device according to claim 13, wherein said pump means is designed to operate more than ten feet under a body of water.

15. A nozzle of a type through which water is pumped, comprising:

(a) a contraction member defining an upstream end of the nozzle, said contraction member having a converging profile, wherein said converging profile of said contraction member is defined by the equation $y=(3/32)*(x)*(x)*(3-x)$, where x represents a measure of distance along the length of said contraction member, and y represents a measure of decrease in radius of said contraction member along the length and wherein the radius of said contraction member decreases to a diameter of approximately 1¼ inches;

(b) a diffuser member, in fluid communication with and downstream from said contraction member, wherein said diffuser member has a diverging profile and an exit that faces downstream;

(c) an air delivery tube, extending within said contraction member, and having an entrance exposed to the atmosphere and an exit that faces downstream;

wherein said diffuser member is arranged and configured of a substantial enough length such that the pressure recovery created by the diverging profile of said diffuser member causes the fluid around the air in said diffuser member to collapse on the air within said diffuser member, whereby the bubble size is minimized and aeration is maximized.

16. A nozzle according to claim 15, wherein the outlet diameter to length ratio of said diffuser member is between 1:5 and 1:6.

17. A nozzle according to claim 15, further comprising a focus member, in fluid communication with and downstream from said diffuser member, wherein said focus member has a uniform diameter and an exit that faces downstream.

18. A nozzle according to claim 17, wherein said contraction member, said diffuser member, said focus member, and said air delivery tube are coaxial and integrally joined to one another.

19. A nozzle according to claim 15, wherein the inlet to outlet ratio of said diffuser member is between 0.55 and 0.65.

20. A nozzle according to claim 19, wherein the inlet to outlet ratio of said diffuser member is between 0.55 and 0.65.

21. A nozzle according to claim 15, further comprising a throat member positioned between and in fluid communication with said contraction member and said diffuser member, wherein said throat member has a uniform diameter, and wherein said air delivery tube does not extend within said throat member.

22. A nozzle according to claim 21, further comprising a focus member, in fluid communication with and downstream from said diffuser member, wherein said focus member has a uniform diameter and an exit that faces downstream.

23. A nozzle according to claim 21, wherein said contraction member, said throat member, said diffuser member, and said air delivery tube are coaxial and integrally joined to one another.

24. A nozzle of a type through which water is pumped, comprising:

(a) a contraction member defining an upstream end of the nozzle, said contraction member having a converging profile, wherein said converging profile of said contraction member is defined by the equation $y=x^3(0.23148-0.11574x+0.15432x^2)$, where x represents a measure of distance along the length of said contraction member, and y represents a measure of decrease in radius of said contraction member along the length and wherein the radius of said contraction member decreases to a diameter of approximately 1-3/4 inches;

(b) a diffuser member, in fluid communication with and downstream from said contraction member, wherein said diffuser member has a diverging profile and an exit that faces downstream;

(c) an air delivery tube, extending within said contraction member, and having an entrance exposed to the atmosphere and an exit that faces donwstream;

wherein said diffuser member is arranged and configured of a substantial enough length such that the pressure recovery created by the diverging profile of said diffuser member causes the fluid around the air in said diffuser member to collapse on the air within said diffuser member, whereby the bubble size is minimized and aeration is maximized.

* * * * *

UNITED STATES PATENT AND TRADEMARK OFFICE

CERTIFICATE OF CORRECTION

PATENT NO. : 5,167,878

DATED : December 1, 1992

INVENTOR(S) : DOMINIC S. ARBISI et al.

It is certified that error appears in the above-identified patent and that said Letters Patent is hereby corrected as shown below:

In column 6, line 17, for "plac-d" read --placed--.
In column 6, line 55, after "unstable" insert --.--.
In column 6, line 56, for "flower" read --blower--.
In column 6, line 63, for "bodes" read --bodies--.
In column 7, line 32, for "that" read --the--.
In column 7, line 35, after "delivery" insert --tube,--.
In column 7, line 37, for "substantially" read --substantial--.
In column 7, line 44, for "aid" read --said--.
In column 8, lines 1-2, for "delivery air" read --air delivery--.
In column 10, lines 20-21, for "donwstream" read --downstream--.

Signed and Sealed this

Second Day of November, 1993

Bruce Lehman

*Attest:*

BRUCE LEHMAN

*Attesting Officer*

*Commissioner of Patents and Trademarks*